US011274387B1

(12) United States Patent
Weiner

(10) Patent No.: US 11,274,387 B1
(45) Date of Patent: Mar. 15, 2022

(54) UNDER-TUFTING CARPET METHOD

(71) Applicant: Robert S. Weiner, Atlanta, GA (US)

(72) Inventor: Robert S. Weiner, Atlanta, GA (US)

( * ) Notice: Subject to any disclaimer, the term of this patent is extended or adjusted under 35 U.S.C. 154(b) by 762 days.

(21) Appl. No.: 16/132,917

(22) Filed: Sep. 17, 2018

Related U.S. Application Data

(63) Continuation-in-part of application No. 16/016,838, filed on Jun. 25, 2018.

(60) Provisional application No. 62/553,430, filed on Sep. 1, 2017.

(51) Int. Cl.
*D05C 15/10* (2006.01)
*D05C 15/34* (2006.01)
*D05C 17/02* (2006.01)

(52) U.S. Cl.
CPC ..... *D05C 17/026* (2013.01); *D05C 15/10* (2013.01); *D05C 15/34* (2013.01); *D05D 2303/00* (2013.01); *D10B 2331/02* (2013.01); *D10B 2331/04* (2013.01); *D10B 2503/04* (2013.01)

(58) Field of Classification Search
CPC .... D05C 17/02; D05C 17/023; D05C 17/026; D05C 15/10; D05C 15/20; D05C 15/26; D05C 15/30; D06N 7/0065; D06N 7/0068; D06N 7/0071; D06N 7/0073; D06N 7/0081; D05D 2303/00
See application file for complete search history.

(56) References Cited

U.S. PATENT DOCUMENTS

2003/0143907 A1* 7/2003 Funasako ..... B32B 27/12 442/43

* cited by examiner

*Primary Examiner* — Nathan E Durham
(74) *Attorney, Agent, or Firm* — Miller & Martin PLLC; Stephen J. Stark

(57) ABSTRACT

Carpet designs can be provided having new features. Specifically, design elements can be provided intermediate or on the primary backing and the stitches with various embodiments in an "under tufted" manner.

17 Claims, 2 Drawing Sheets

UNDER-TUFTING CARPET METHOD

CLAIM OF PRIORITY

This application is a continuation in part of U.S. patent application Ser. No. 16/016,838 filed Jun. 25, 2018, which claims the benefit of U.S. Provisional Application No. 62/553,430 filed Sep. 1, 2017, both of which are incorporated herein by reference in their entirety.

FIELD OF THE INVENTION

Flooring goods can be made which provide a wear surface which is traditionally opposite the traditional wear surface when being tufted (i.e., the spaced apart stitching on the reverse side forms the wear surface instead of the loops or cut loops which are normally provided on the exposed side), and improvements over the prior art can be provided such as "under-tufted" designs.

Of course, many carpets utilize a traditional wear surface side as well. Typically, needles tuft primary backing from a back side of the backing through penetrations to provide loops on the front side (which could be cut or sheared at least in certain locations, or not) to provide the wear layer which provides a carpet design when viewed from above the loops. Under-tufting can be provided in such constructions as well by providing design elements on the front side of the backing.

BACKGROUND OF THAT INVENTION

A number of efforts have been made over the years to provide inverted carpet type constructions. Specifically, U.S. Pat. No. 4,563,378 shows a flooring configuration for automotive uses wherein cut loops are bonded in a secure manner thereby leaving the reverse side to be exposed as a wear face. Improvements to this basic idea include WO99/55954 and U.S. Pat. No. 6,740,386 as well as U.S. Pat. No. 5,560,307.

While much effort has been devoted to designing carpet from what is traditionally the front or loop face of tufted goods, relatively little effort is believed to have been expended into creating creative patterns off of the back stitch face to be used as a wear face. Little effort appears to have been directed into how short or low the pile height can be with finished goods.

Improvements to back stitch or inverted carpet constructions are believed to be desirable in the marketplace. Additionally, improvements on the back stitch side as a wear side have led to improvements which could be implemented on the front stitch side as well.

SUMMARY OF THE INVENTION

It is an object of many embodiments of the present invention to provide an improved carpet construction and method of manufacture.

It is another object of many embodiments of the present invention to provide an improved carpet and method of manufacture providing as a wear surface of the carpet above certain design elements.

Significant effort has been devoted to different carpet styles utilizing the traditional loop face (or cut loop face) as a wear surface. There are believed to be many, many styles directed thereto. However, a much smaller body of art exists as it relates to utilizing the back stitch face as a wear surface for the marketplace in providing extremely short loops.

No party is known to laterally shift possibly continuously across the width of the carpet so as to provide repeating and preferably spaced apart patterns with such pattern appears to continuously laterally progress across its length underneath a traditional carpet pattern. Furthermore, no one is known to utilizing laterally shifting or cross tufting, possibly with back (i.e., tufted) from an opposite direction through the backing stitches or otherwise, underneath a carpet pattern so as to create the impression of a lateral feature relative to a direction of tufted goods. After discovering the desirability of design improvements on the back stitch side, similar technology was applied to the front stitch side and was found to provide desirable new designs.

Furthermore, while companies have backed carpet constructions with latex or pre-coats possibly over vinyl and/or fiberglass stabilizers, still further improvement such as providing square tile squares, planks and/or other shapes as well as sheet goods such as broadloom or other styles are believed to be desirable. Furthermore, up to 100% nylon yarns can be utilized for the exposed surface, if not up to at least 95% of the exposed surface.

Weights of the product can vary to be as high as one desires to as low as possibly 6 to 8 ounces and certainly less than 10 ounces while still providing greater than 95% coverage. Weights could also extend up to or even over 60 ounces.

Using a very narrow hook such as a wire, face stitches can be extremely short for some embodiments.

Design elements may be provided on the primary backing (below the tufts of stitches) in ways never before provided to the marketplace on the front or back of the primary backing depending upon which side is selected for a wear surface. While one could certainly print designs on the primary backing which might be useful to backlight to identify to add other effects, or even possibly show through, at least partially at certain locations, other embodiments could have design elements such as ribbons, yarn(s), cloth strips, or other materials extending along portions of the primary backing before and during the tufting process. Accordingly, as the tufting machine tufts yarn through the primary backing with needles, the needles could also puncture, pass beside and/or at least assist in retaining the design elements between the stitch and the primary backing as the carpet is tufted, and before providing a carpet product with the tufted stitches visible from above when installed. The inserted design element material could be at least partially visible beside the stitches and/or provide elevational differences to lift at least some of the stitches relative to others.

While certainly over tufting can be performed over a previously tufted carpet for many embodiments, tufting a carpet design through a design element or "under-tufting", such as at least partially laterally extending yarn(s) extending across the primary backing (possibly held in place with connectors, penetrations, such as could be performed with a mending gun or other instrumentality in an opposite manner as the carpet pattern overlayed on top thereof, even in an automated manner such as with a controller controlling the placement of the design element(s)) could be done thus giving rise to new effects. Design elements do not cover over the entire primary backing, but instead are separated by gaps and/or may provide repeating patterns below carpet design tufting by tufting machines on top thereof.

The tuft bond can be greatly increased up to the point to where the ability to attempt to pull out a tuft cannot be performed potentially without breaking the fibers. Furthermore, various cushioning effect can be provided over and above the technology provided by prior art.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings illustrate preferred embodiments of the invention and, together with the description, serve to explain the invention. These drawings are offered by way of illustration and not by way of limitation.

DETAILED DESCRIPTION OF THE PREFERRED EMBODIMENT

Figure 1:
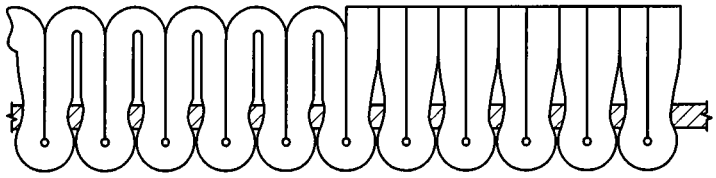
FIG. 1 is a schematized cross section view of a tufted top component of a flooring of the prior art.

FIG. 1 shows a prior art technique that have been performed in the past.

In an effort to have increased design opportunity, the applicant began focusing on improved aesthetics and performance characteristics for different flooring products to be available in the marketplace. The back stitch was a first area of focus for a wear surface, but improvements led improvements to the front stitch for a wear surface as well.

The applicant and/or others have begun utilizing almost 100% nylon of a solution dyed yarn for yarns 12,14 in tufted goods 10 for some embodiments. Up to 100% polyester yarns for yarn 12,14 have been used in various embodiments as well. Other yarns may be utilized with still other embodiments.

Figure 2:
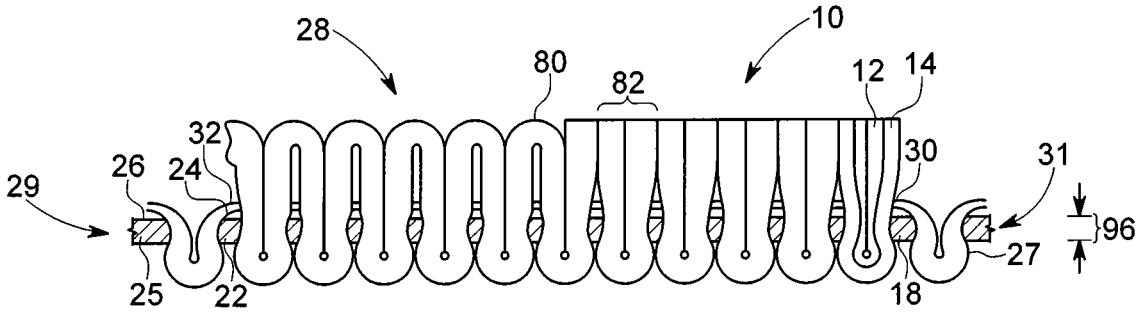
FIG. 2 is a schematized cross section view of a tufted component of the present invention.
Figure 3:
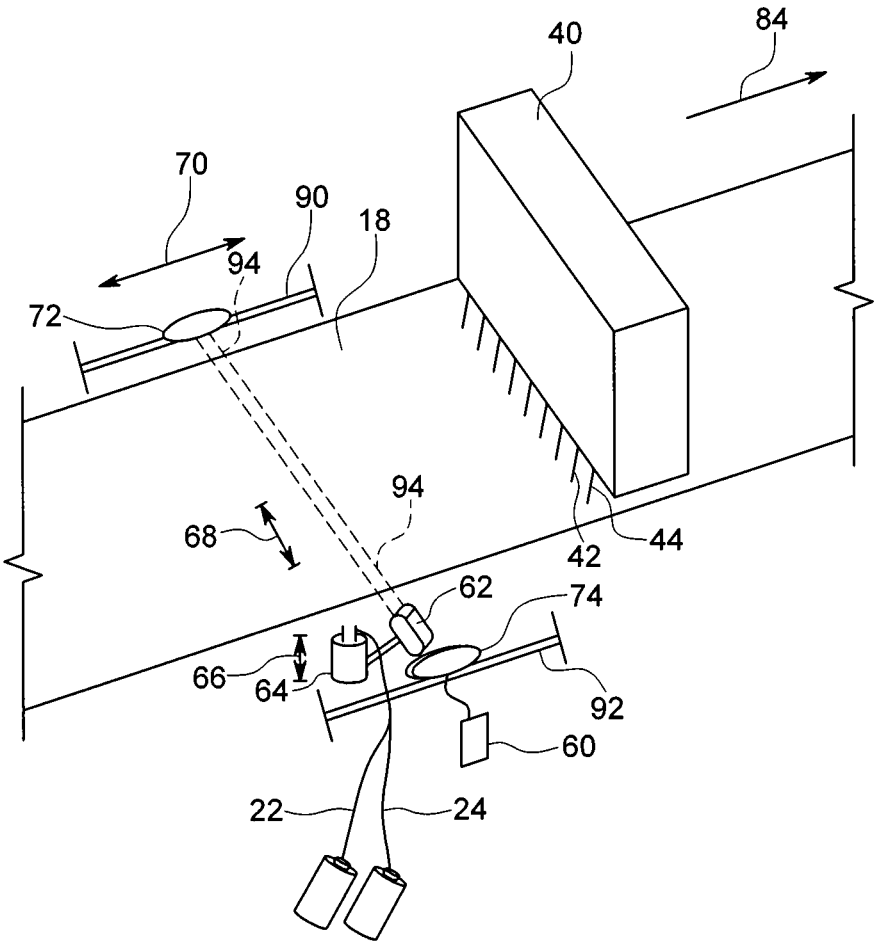
FIG. 3 is a top perspective view of one embodiment of equipment used to make the embodiment of FIG. 2.
Figure 4:
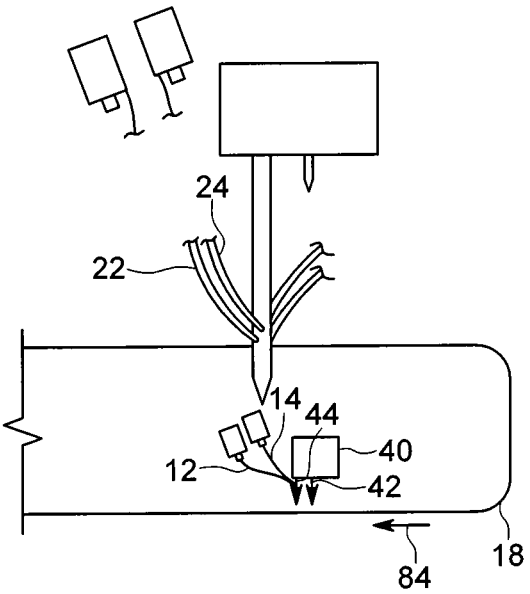
FIG. 4 is a schematic view illustrating the manufacturing process of the embodiment of FIGS. 2 and 3.

FIGS. 3 and 4 show goods 10 manufactured (as shown in FIG. 2) though a tufting process showing both the yarns 12,14 being directed through a single penetration 30 of a backing 18. FIG. 2 shows a finished or tufted good 10 also often referred to a carpet.

Carpet or tufted goods 10 are typically made as illustrated in FIGS. 3-4 by providing a tufting machine 40 with a series of needles 42,44, etc., which direct one or more yarns such as yarns 12,14 through penetrations 30 created by the respective needles 42,44, etc. In the illustrated embodiment, two yarns 12,14 are directed through a single penetration 30 as shown in FIG. 2 although more than two yarns 12,14, etc., or even a single yarn 12 or 14, etc., could be directed by the specific needles 42,44 through the backing 18 as would be understood those ordinarily skilled in the art.

What differentiates this technology from prior art technology is that prior to tufting, the yarns 12,14 through the backing 18 to provide a carpet pattern 28, another yarn or yarns 22,24 or even other design element 32 is directed along what will become an upper surface 26 of backing 18 which will preferably become at least partially visible through a portion of the carpet pattern 28 as viewed from above (such as beside some portions of yarns 12,14 and/or by elevating portions of yarns 12,14). As shown in FIG. 3, this can be accomplished such as by applying the yarns 22,24 or other design elements 32 to a surface 26 of the carpet 18 which will then preferably become the upper surface for the finished goods 10 and become effectively a systemic and/or other design element part of the carpet design 28.

Stripes 32 could be a design element 32 and could take many forms whether it be a straight line stripe, a series of angled lines, a curved line, discontinuous lines, combinations of straight lines with curved lines, of course, combinations of these or other features could be provided with other embodiments. Design elements 32 are preferably spread apart, such as by gaps, so that where there is no gap, the carpet pattern 28 appears directly above the backing 18.

By providing an ability to apply or at least temporarily hold the stripes on or relative to the backing 18 such as with a computer or other controller 60 controlling a carriage 62 having a stripe applicator 64 (such as a mending gun or other applicator 64 receiving one or more yarn strands 22,24), the designs may be applied or selectively applied, or even connected to the backing 18, which become stripes and/or other design at the backing 18. The tufting machine 40 can then impart additional elements under the carpet design 28 in the various embodiments and/or others. The applicator 64 can move up and down relative to trolley 62 in direction 66 relative to trolley 62 and/or in a lateral direction 68 with the trolley 62 and even move in axis 70 for at least some embodiments utilizing trolleys 72 and/or 74, all of which can be controlled by process 60 and/or other controller. Gaps can be provided between various stripes using gaps such as lateral gaps (lateral can be interpreted for many embodiments as perpendicular to a direction to tuft) and possibly can assist in spacing stripes apart so the carpet design 28 can be tufted over the "under-tufted" design element(s) 32. Design elements can be laterally spaced by gaps and/or by gaps in the direction of tuft (such as a repeating pattern or otherwise).

Other axes or movement could be important to other applicators 64. Multiple applicators 64 possibly of different types could be utilized as well. Applicators 64 preferably apply design elements 32 differently than tufts 82,84 are created for many, many embodiments. Some embodiments extend the design element over a significant distance, such as at least a distance of five stitches of tufts 82,84, if not the lateral width of the backing 18. Some design elements can extend away from the face 26 of the backing 18 further than at least some tufts 82,84 to give still further effects. Some embodiments connect the design element at spaced apart locations, such as spaced apart penetrations 25,27 (which for the illustrated embodiment, are oppositely oriented relative to tufts 82,84). Other embodiments provide physically spaced apart design elements 32 (as indicated by discontinuous lines), spaced by gaps, etc. For many embodiments, the design element 32 has at least a length on top of the backing that does not proceed in and out of the same penetration, along the face 26 of the backing 18.

This technology could also be applied to its use in U.S. patent application Ser. No. 16/016,838, incorporated herein by reference in its entirety, so as to not only be applied to the front stitch pattern, but also be applied to the back stitch pattern to the extent not already disclosed in application Ser. No. 16/016,838.

Stripes or design element 32 could take the form of one or more yarns such as 22,24 or the other decorative items placed against the surface 26 of the backing 18 and include, but are not limited to, wire, ribbon, fabric and/or other decorative elements. Additionally, the preferred method of attaching the stripes 32 particularly when they are yarn is utilizing a structure such as a mending gun structure illustrated as applicator 64 connected to carrier 62. Other methods of connecting the stripes 32 to the backing 18 could include adhesives or possibly be retained only by the yarn tufts such as tufts 80,82, etc., as they penetrate through the penetrations 30 and the backing 18.

Additionally, there is normally a direction of tuft such as direction 84 illustrated when forming the tufts 82,84. Possibly combining a shifting needle bar, or even cross tufting as is discussed in U.S. Pat. No. 9,512,548 incorporated herein by reference, diagonal or lateral stitches can be provided to provide somewhat of a unique effect particularly when done with multiple yarns and the spacing between stitches. Additionally, a repeating sliding effect could continue to effectively provide a repeating pattern. "Random" stripes to provide the design 28 could occur with other embodiments.

With this technology, an appearance of "under tufting" can occur either in one or two ways either with the same orientation of tuft as was originally provided when the tufting machine provided tufts 82,84 and/or oppositely, whereby both back stitches and front stitches are imparted onto carpet and/or goods 10 from a common face 26 of backing 18. This can give rather unique effects also not previously provided in the prior art, possibly when combined with cross tufting.

As with the traditional stitches, the loops or tufting 82 could have a predetermined height based on the looping characteristics of those tufting machines such as a high or low loop. The stitches 82, 84 (and/or stripes 32) could normally be a relatively flat pull possibly elevated to at least some degree with lateral shifting which could still then be combined with low and/or high loops for tufts 80,82 whether cut or sheared or not, with the carpet reversed and tufted and/or with additional over tufting to then overlay stitches on top of stitches whether run in the same direction of feed 84 or in another direction. Shifting needlebars, cross tufting or other techniques could provide stripes of various lengths and/or directions or other effects. The carpet design 28 is effectively continuous as provided over the discrete design elements 32, which are spaced apart from one another for many embodiments, and preferably are not commonly oriented loops oriented identically as loops 82,84 of the carpet design for at least many embodiments. This is under-tufting—to provide the design element first, rather than over-tufting—to provide after the continuous carpet design 28 has been tufted.

Some embodiments could provide a method of producing carpet 10 comprising the steps of (a) providing a backing 18 having been tufted with loops 80 on a front side 26 of the carpet 10 by directing the backing 18 through a first tufting machine 45 whereby selected needles 42,44 direct yarn strands 12 and/or 14 through openings or penetrators 30 in the backing 18 led by the needles 43,44, etc. thereby providing a first selected loop 80 (and others) on the front side 26 of the backing 18 opposite the side from which the needles 16 contact the backing 18 which is a back side 19 of the primary backing 18 after first applying at least one design element 32 selected from the group of at least one yarn (such as multiple yarns, possibly with two 22,24 in contact, possibly (at least possibly) in at least preferably a lateral direction (as opposed to a direction of tuft 84 to which a lateral direction would be perpendicular thereto), a ribbon, cloth, printing on the first side of the primary backing 18, or other design elements, and (b) and tufting so that the design element becomes a portion of the design of the carpet by one of lifting the tufted loops to provide a texture and/or providing design features seen through the tufted loops 82,84 with the design element(s) 32 preferably not continuously provided above the backing 18. Instead, portions of backing 18 are directly below at least some tufts 82,84 which is different than "over-tufting" techniques.

For some embodiments, the stitches 80,82 may extend through the design element 32 such as between adjacent yarns 12,14, etc., (possibly through fabric such as cloth, ribbon, etc.). Adjacent yarns 22,24 of a design element 32 and/or others may contact one another, or even be twisted at least somewhat along a lateral direction (relative to the direction of tuft) and/or otherwise provided. Penetrations 25,27 may be used such as at or near opposing edges 29,31 of a backing 18 (or possibly even some intermediate thereto by directing yarns into the backing 18 such as by an applicator 60, possibly such as a mending gun or other type construction to apply yarns 22,24 or other constructions, particularly if the design element 32 is something other than yarns 22 and/or 24). Other techniques may or may not be employed to at least temporarily hold design element 32 in at least a desired approximate position on the primary backing 18 before tufting with the tufting machine 40 and/or other tufting machine. The applicator 64 may be mounted relative to tracks 90,92,94 which may be under the direction of a controller 60 which may direct the movement (at least linearly, such as laterally relative to the direction of tuft) of the applicator 60 to apply the design element 32 at specific locations on the primary backing 18.

The applicator 60 can also move into and out of engagement with the primary backing 18 as would be understood by those of ordinary skill in the art. Furthermore, some configurations may provide for the movement of the applicator 60 parallel to the direction (8 of tuft such as by connecting the applicator relative to trolleys 72,24, and/or the tracks 90,92,94, etc., preferably under the direction of the controller 60.

When the design element 82 has sufficient thickness 96, it can push the back stitches 80,82 away from the primary backing 18 more than in locations where there is no design element 32. Portion(s) of design element 32 may be seen beside such stripes 22 or even "through" them (and/or provide texture). It may be that the applicator 60 applies a design element 32 to be principally oriented at least partially in lateral direction relative to the direction of tuft 84 for some embodiments.

Depending on the cushioning selected by the user and/or locking materials, the carpet 10 can have one or a plurality of preferred resilience and/or wear characteristics.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of producing carpet comprising the steps of:

a) applying a first design element against a front side of a primary backing, said first design element spaced by gaps maintaining portions of the front side of the backing exposed beside the design element; and then b) directing the primary backing through a first tufting machine whereby selected needles direct yarn strand through respective penetrations created through the primary backing led by the needles thereby providing a first selected loops on the front side of the backing opposite a direction from which the needles initially contacts the primary backing to provide a carpet pattern over and including the design element which is at least partially visible as one of alongside and under the first selected loops and having the first selected loops extend through at least a portion of the design element on the front side of the primary backing; and c) wherein the design element is selected from one or more yarns, ribbon, and fabric.

2. The method of claim 1 wherein the design element is continuously applied while simultaneously tufting with the first tufting machine.

3. The method of claim 2 wherein the design element is applied with a controller as a portion of a continuous process.

4. A method of producing carpet comprising the steps of:

a) applying a first design element against a front side of a primary backing, said first design element spaced by gaps maintaining portions of the front side of the backing exposed beside the design element; and then b) directing the primary backing through a first tufting machine whereby selected needles direct yarn strand through respective penetrations created through the primary backing led by the needles thereby providing a first selected loops on the front side of the backing opposite a direction from which the needles initially contacts the primary backing to provide a carpet pattern over and including the design element which is at least partially visible as one of alongside and under the first selected loops; and c) wherein the design element comprises yarns and at least two of the yarns contact one another as the yarns proceed laterally relative to a direction of tuft to provide the design element and the design element is continuously applied while simultaneously tufting with the first tufting machine.

5. The method of claim 4 wherein the at least two of the yarns have at least some predetermined twist.

6. The method of claim 2 wherein the yarns are secured with penetrations through the primary backing.

7. The method of claim 2, wherein the yarns extend laterally relative to a direction of tuft.

8. A method of producing carpet comprising the steps of:

a) applying a first design element against a front side of a primary backing, said first design element spaced by gaps maintaining portions of the front side of the backing exposed beside the design element; and then b) directing the primary backing through a first tufting machine whereby selected needles direct yarn strand through respective penetrations created through the primary backing led by the needles thereby providing a first selected loops on the front side of the backing opposite a direction from which the needles initially contacts the primary backing to provide a carpet pattern over and including the design element which is at least partially visible as one of alongside and under the first selected loops and is applied with an applicator moving along a track prior to the design element moving to the tufting machine under the direction of a controller as a portion of a continuous process and is continuously applied while simultaneously tufting with the first tufting machine; and c) wherein the design element is selected from one or more yarns, ribbon, and fabric.

9. The method of claim 8 wherein the track at least assists in providing at least linear motion of the applicator along a lateral direction perpendicular to a direction of tuft for at least a first design.

10. The method of claim 9 wherein the applicator selectively moves into and out of engagement with the primary backing.

11. The method of claim 10, wherein the applicator moves parallel to the direction of tuft while applying the design element.

12. The method of claim 11 wherein the design element is principally oriented in a lateral direction perpendicular to the direction of tuft.

13. A method of producing tufted carpet comprising the steps of:

a) applying at least two design elements adjacent to a front side of a primary backing with a gap spacing the design elements apart above the primary backing; and then b) directing the primary backing through a tufting machine whereby selected needles direct yarn strands through openings in the primary backing led by the needle as a stitch from a back side of the primary backing thereby each respectively providing a first selected loop on a front side of the primary backing opposite the direction from which the needles contact the backing, wherein the design element is at least partially visible from a front side of the tufted carpet as one of alongside the loop and below the loop; and c) having the stitch extend through at least a portion of the design element on the front side of the primary backing.

14. The method of claim 13 wherein the design element is selected from the group of at least one yarn, ribbon, cloth, printing on the primary backing.

15. The method of claim 14 wherein the design element is a plurality of yarns, and wherein at least two of the plurality of yarns contact one another as the yarns proceed laterally relative to a direction of tuft.

16. The method of claim 15 wherein the design element is applied with a controller as a portion of a continuous process.

17. The method of claim 15 wherein the design element is connected to the primary backing from the front side of the backing through penetrations in an opposite direction of the first selected loop.

* * * * *